US006034049A

United States Patent [19]

Erilli et al.

[11] Patent Number: 6,034,049

[45] **Date of Patent: *Mar. 7, 2000**

[54] MICROEMULSION LIGHT DUTY LIQUID CLEANING COMPOSITIONS

[75] Inventors: Rita Erilli, Liege, Belgium; Barbara Thomas, Princeton, N.J.

[73] Assignee: Colgate-Palmolive Co., Piscataway, N.J.

[ * ] Notice: This patent is subject to a terminal disclaimer.

[21] Appl. No.: 08/893,555

[22] Filed: Jul. 11, 1997

Related U.S. Application Data

[63] Continuation-in-part of application No. 08/514,977, Aug. 14, 1995, abandoned, which is a continuation-in-part of application No. 08/392,569, Feb. 23, 1995, Pat. No. 5,523,025.

[51] Int. Cl.[7] ..... C11D 17/00; C11D 1/74

[52] U.S. Cl. ..... 510/417; 510/101; 510/365; 510/424; 510/405; 510/505; 510/506

[58] Field of Search ..... 510/417, 101, 510/238, 434, 437, 477, 491, 505, 506, 365, 405, 235

[56] References Cited

U.S. PATENT DOCUMENTS

| | | | |
|---|---|---|---|
| 3,776,857 | 12/1973 | Lindner | 252/308 |
| 4,247,425 | 1/1981 | Eagen et al. | 252/548 |
| 4,263,284 | 4/1981 | Schreuder | 424/180 |
| 4,614,622 | 9/1986 | Huettinger et al. | 554/227 |
| 5,403,509 | 4/1995 | Pujol et al. | 252/132 |
| 5,549,840 | 8/1996 | Mondin et al. | 510/365 |
| 5,561,106 | 10/1996 | Erilli et al. | 510/109 |
| 5,571,459 | 11/1996 | Thomas et al. | 510/365 |
| 5,593,958 | 1/1997 | Mondin et al. | 510/417 |
| 5,646,104 | 7/1997 | Erilli et al. | 510/365 |
| 5,716,925 | 2/1998 | Mondin et al. | 510/365 |
| 5,731,281 | 3/1998 | Mondin et al. | 510/417 |
| 5,741,760 | 4/1998 | Mondin et al. | 510/365 |
| 5,767,050 | 6/1998 | Adamy et al. | 510/235 |

*Primary Examiner*—Necholus Ogden
*Attorney, Agent, or Firm*—Richard Nanfeldt

[57] ABSTRACT

A light duty liquid microemulsion composition comprises a mixture of a paraffin sulfonate and an ethoxylated alkyl ether sulfate; a biodegradable compound; a cosurfactant; a perfume, essential oil or water insoluble hydrocarbon; and water.

8 Claims, No Drawings

MICROEMULSION LIGHT DUTY LIQUID CLEANING COMPOSITIONS

RELATED APPLICATION

This application is a continuation in part application of U.S. Ser. No. 8/514,977 filed Aug. 14, 1995 now abandoned which in turn is a continuation in part application of U.S. Ser. No. 8/392,569 filed Feb. 23, 1995 now U.S. Pat. No. 5,523,025.

FIELD OF THE INVENTION

This invention relates to an improved light duty liquid cleaner in the form of a microemulsion designed in particular for cleaning dishware and which is effective in removing grease soil and/or bath soil and in leaving unrinsed surfaces with a shiny appearance.

BACKGROUND OF THE INVENTION

In recent years liquid detergents have become widely accepted for cleaning hard surfaces, e.g., dishware painted woodwork and panels, tiled walls, wash bowls, bathtubs, linoleum or tile floors, washable wall paper, etc. Such liquids comprise clear and opaque aqueous mixtures of water-soluble organic detergents and water-soluble detergent builder salts. In order to achieve comparable cleaning efficiency with granular or powdered cleaning compositions, use of water-soluble inorganic phosphate builder salts was favored in the prior art all-purpose liquids. For example, such early phosphate-containing compositions are described in U.S. Pat. Nos. 2,560,839; 3,234,138; 3,350,319; and British Patent No. 1,223,739.

In view of the environmentalist's efforts to reduce phosphate levels in ground water, improved liquid cleaners containing reduced concentrations of inorganic phosphate builder salts or non-phosphate builder salts have appeared. A particularly useful self-opacified liquid of the latter type is described in U.S. Pat. No. 4,244,840.

However, these prior art liquid detergents containing detergent builder salts or other equivalent tend to leave films, spots or streaks on cleaned unrinsed surfaces, particularly shiny surfaces. Thus, such liquids require thorough rinsing of the cleaned surfaces which is a time-consuming chore for the user.

In order to overcome the foregoing disadvantage of the prior art liquid, U.S. Pat. No. 4,017,409 teaches that a mixture of paraffin sulfonate and a reduced concentration of inorganic phosphate builder salt should be employed. However, such compositions are not completely acceptable from an environmental point of view based upon the phosphate content. On the other hand, another alternative to achieving phosphate-free all-purpose liquids has been to use a major proportion of a mixture of anionic and nonionic detergents with minor amounts of glycol ether solvent and organic amine as shown in U.S. Pat. No. 3,935,130. Again, this approach has not been completely satisfactory and the high levels of organic detergents necessary to achieve cleaning cause foaming which, in turn, leads to the need for thorough rinsing which has been found to be undesirable to today's consumers.

Another approach to formulating liquid detergent composition where product homogeneity and clarity are important considerations involves the formation of oil-in-water (o/w) microemulsions which contain one or more surface-active detergent compounds, a water-immiscible solvent (typically a hydrocarbon solvent), water and a "cosurfactant" compound which provides product stability. By definition, an o/w microemulsion is a spontaneously forming colloidal dispersion of "oil" phase particles having a particle size in the range of about 25 to about 800 Å in a continuous aqueous phase. In view of the extremely fine particle size of the dispersed oil phase particles, microemulsions are transparent to light and are clear and usually highly stable against phase separation.

Patent disclosures relating to use of grease-removal solvents in o/w microemulsions include, for example, European Patent Applications EP 0137615 and EP 0137616—Herbots et al; European Patent Application EP 0160762—Johnston et al; and U.S. Pat. No. 4,561,991—Herbots et al. Each of these patent disclosures also teaches using at least 5% by weight of grease-removal solvent.

It also is known from British Patent Application GB 2144763A to Herbots et al, published Mar. 13, 1985, that magnesium salts enhance grease-removal performance of organic grease-removal solvents, such as the terpenes, in o/w microemulsion liquid detergent compositions. The compositions of this invention described by Herbots et al. require at least 5% of the mixture of grease-removal solvent and magnesium salt and preferably at least 5% of solvent (which may be a mixture of water-immiscible non-polar solvent with a sparingly soluble slightly polar solvent) and at least 0.1% magnesium salt.

However, since the amount of water immiscible and sparingly soluble components which can be present in an o/w microemulsion, with low total active ingredients without impairing the stability of the microemulsion is rather limited (for example, up to about 18% by weight of the aqueous phase), the presence of such high quantities of grease-removal solvent tend to reduce the total amount of greasy or oily soils which can be taken up by and into the microemulsion without causing phase separation. The following representative prior art patents also relate to liquid detergent cleaning compositions in the form of o/w microemulsions: U.S. Pat. Nos. 4,472,291—Rosario; 4,540,448—Gauteer et al; 3,723,330—Sheflin; etc.

Liquid detergent compositions which include terpenes, such as d-limonene, or other grease-removal solvent, although not disclosed to be in the form of o/w microemulsions, are the subject matter of the following representative patent documents: European Patent Application 0080749; British Patent Specification 1,603,047; 4,414,128; and 4,540,505. For example, U.S. Pat. No. 4,414,128 broadly discloses an aqueous liquid detergent composition characterized by, by weight:

(a) from about 1% to about 20% of a synthetic anionic, nonionic, amphoteric or zwitterionic surfactant or mixture thereof;

(b) from about 0.5% to about 10% of a mono- or sesquiterpene or mixture thereof, at a weight ratio of (a):(b) being in the range of 5:1 to 1:3; and (c) from about 0.5% about 10% of a polar solvent having a solubility in water at 15° C. in the range of from about 0.2% to about 10%. Other ingredients present in the formulations disclosed in this patent include from about 0.05% to about 2% by weight of an alkali metal, ammonium or alkanolammonium soap of a $C_{13}$–$C_{24}$ fatty acid; a calcium sequestrant from about 0.5% to about 13% by weight; non-aqueous solvent, e.g., alcohols and glycol ethers, up to about 10% by weight; and hydrotropes, e.g., urea, ethanolamines, salts of lower alkylaryl sulfonates, up to about 10% by weight. All of the formulations shown in the Examples of this patent include relatively large amounts of detergent builder salts which are detrimental to surface shine.

A number of patents teach esterified ethoxylated glycerol compounds for various applications. These patents are Great Britain 1,453,385; Japan 59-1600 and Japan 58-206693 U.S. Pat. No. 5,403,509 and European Patent Application 0586, 323A1. These publications fail to appreciate that a mixture of esterified ethoxylated glycerol and nonesterified ethoxylated glycerol, when used in a light duty liquid cleaning composition, functions as a grease release agent thereby improving plate cleaning.

SUMMARY OF THE INVENTION

The present invention provides an improved, clear, light duty liquid cleaning composition having improved interfacial tension which improves cleaning plates in the form of a microemulsion which is suitable for cleaning hard surfaces such as dishes, plastic, vitreous and metal surfaces having a shiny finish. The instant compositions also exhibit superior foaming properties.

The compositions of the instant invention use an esterified ethoxylated polyhydric alcohol have an ecotoxicity value as measured by the LC50 test as deferred by The Organization for Economic Cooperation and Development (OECD) (of which the United States is a member) in OECD Test No. 202 of at least 0.18 ml/L measured on Daphniae microorganisms as well as reduced ecotoxicity.

The light duty liquid microemulsion compositions of the instant invention can be generally described as comprising approximately by weight:

(a) 5 to 26%, more preferably 10 to 24%, of an alkali metal salt of a $C_{13}$–$C_{17}$ secondary alkane sulfonate (or paraffin sulfonate) surfactant and an alkali metal salt of an ethoxylated $C_8$–$C_{18}$ alkyl ether sulfate surfactant, wherein the ratio of sulfonate surfactant to the sulfate surfactant is about 1.2:1 to about 24:1, more preferably about 1.35:1 to about 15:1;

(b) about 2% to 29%, more preferably 8% to 24% of a mixture of a fully esterified ethoxylated polyhydric alcohol, a nonesterified ethoxylated polyhydric alcohol and a partially esterified ethoxylated polyhydric alcohol;

(c) 0.4% to 10%, more preferably 2.0% to 7.0%, of a perfume, an essential oil or a water insoluble hydrocarbon;

(d) 0 to 25% of a cosurfactant, more preferably 1 to 20% of a cosurfactant; and (e) the balance being water, wherein the composition has a Brookfield LVT viscosity at 25° C. at 30 rpms using a #2 spindle of about 20 to 500 cps, more preferably about 200 to 450 cps, a pH of about 5 to about 7, and a light transmission of at least about 95%, more preferably at least about 98%.

The light duty liquid microemulsion composition also comprise approximately by weight:

(a) 2% to 20% of a mixture of a fully esterified ethoxylated polyhydric alcohol, an ethoxylated nonesterified polyhydric alcohol and an ethoxylated partially esterified ethoxylated polyhydric alcohol;

(b) 0 to 25% of a zwitterionic surfactant;

(c) 0 to 20% of an ethoxylated $C_{12-18}$ alkyl ether sulfate;

(d) 0.4% to 10% of a perfume, essential oil or a water insoluble hydrocarbon;

(e) 0 to 25% of a cosurfactant; and (f) the balance being water.

Excluded from the instant composition are ethoxylated nonionic surfactants formed from the condensation product of a phenol or a fatty alcohol and ethylene oxide and/or propylene oxide. Also excluded from the instant compositions are grease release agents such as choline chloride, alkyl polyglucoside surfactants, 1-undecanol and aliphatic organic acids.

DETAILED DESCRIPTION OF THE INVENTION

The present invention relates to a stable microemulsion composition approximately by weight: 5% to 26% of a mixture of a paraffin sulfonate and an ethoxylated alkyl ether sulfate surfactant, 0% to 25% of a cosurfactant, 2% to 29% of a biodegradable compound which functions as a solubilizing agent, 0 to 25% of a zwitterionic surfactant, 0.4% to 10% of a water insoluble hydrocarbon, essential oil, or a perfume and the balance being water, said composition having a light transmission of at least about 95%.

According to the present invention, the role of the hydrocarbon can be provided by a non-water-soluble perfume. Typically, in aqueous based compositions the presence of a solubilizers, such as alkali metal lower alkyl aryl sulfonate hydrotrope, triethanolamine, urea, etc., is required for perfume dissolution, especially at perfume levels of about 1% and higher, since perfumes are generally a mixture of fragrant essential oils and aromatic compounds which are generally not water-soluble. Therefore, by incorporating the perfume into the aqueous cleaning composition as the oil (hydrocarbon) phase of the ultimate o/w microemulsion composition, several different important advantages are achieved.

First, the cosmetic properties of the ultimate cleaning composition are improved: the compositions are both clear (as a consequence of the formation of a microemulsion) and highly fragranced (as a consequence of the perfume level).

Second, the need for use of solubilizers, which do not contribute to cleaning performance, is eliminated.

As used herein and in the appended claims the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from about 0% to about 80%, usually from about 10% to 70% by weight, the essential oils themselves being volatile odoriferous compounds and also serving to dissolve the other components of the perfume.

In the present invention the precise composition of the perfume is of no particular consequence to cleaning performance so long as it meets the criteria of water immiscibility and having a pleasing odor. Naturally, of course, especially for cleaning compositions intended for use in the home, the perfume, as well as all other ingredients, should be cosmetically acceptable, i.e., non-toxic, hypoallergenic, etc.

The hydrocarbon such as a perfume is present in the dilute o/w microemulsion in an amount of from about 0.4% to about 10% by weight, preferably from about 0.4% to about 3.0% by weight, especially preferably from about 0.5% to about 2.0% by weight. If the amount of hydrocarbon (perfume) is less than about 0.4% by weight it becomes difficult to form the o/w microemulsion. If the hydrocarbon (perfume) is added in amounts more than about 10% by weight, the cost is increased without any additional cleaning benefit and, in fact, with some diminishing of cleaning performance insofar as the total amount of greasy or oily soil which can be taken up in the oil phase of the microemulsion will decrease proportionately.

Furthermore, although superior grease removal performance will be achieved for perfume compositions not containing any terpene solvents, it is apparently difficult for perfumers to formulate sufficiently inexpensive perfume compositions for products of this type (i.e., very cost sensitive consumer-type products) which includes less than about 20%, usually less than about 30%, of such terpene solvents.

Thus, merely as a practical matter, based on economic consideration, the dilute o/w microemulsion detergent cleaning compositions of the present invention may often include as much as about 0.2% to about 7% by weight, based on the total composition, of terpene solvents introduced thereunto via the perfume component. However, even when the amount of terpene solvent in the cleaning formulation is less than 1.5% by weight, such as up to about 0.6% by weight or 0.4% by weight or less, satisfactory grease removal and oil removal capacity is provided by the inventive diluted o/w microemulsions.

In place of the perfume one can employ an essential oil, such as D-limonene dipentene, I-limonene, or alpha-Terpineol or a water insoluble paraffin or isoparaffin having about 6 to about 18 carbon at a concentration of about 0.4 to about 10 wt. percent, more preferably 0.4 to 6.0 wt. %.

Suitable essential oils are selected from the group consisting of: Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Borneol Flakes (China), Camphor oil, White, Camphor powder synthetic technical, Cananga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Coumarin 69° C. (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), Wintergreen.

Suitable water-soluble non-soap, anionic surfactants used in the instant compositions include those surface-active or detergent compounds which contain an organic hydrophobic group containing generally 8 to 26 carbon atoms and preferably 10 to 18 carbon atoms in their molecular structure and at least one water-solubilizing group selected from the group of sulfonate, sulfate and carboxylate so as to form a water-soluble surfactant. Usually, the hydrophobic group will include or comprise a $C_8$–$C_{22}$ alkyl, aryl or acyl group. Such surfactants are employed in the form of water-soluble salts and the salt-forming cation usually is selected from the group consisting of sodium, potassium, ammonium, magnesium and mono-, di- or tri-$C_2$–$C_3$ alkanolammonium, with the sodium, magnesium and ammonium cations again being preferred.

Examples of suitable sulfonated anionic surfactants are the well known higher alkyl mononuclear aromatic sulfonates such as the higher alkyl benzene sulfonates containing from 10 to 16 carbon atoms in the higher alkyl group in a straight or branched chain, $C_8$–$C_{15}$ alkyl toluene sulfonates and $C_8$–$C_{15}$ alkyl phenol sulfonates.

A preferred sulfonate is linear alkyl benzene sulfonate having a high content of 3-(or higher) phenyl isomers and a correspondingly low content (well below 50%) of 2-(or lower) phenyl isomers, that is, wherein the benzene ring is preferably attached in large part at the 3 or higher (for example, 4, 5, 6 or 7) position of the alkyl group and the content of the isomers in which the benzene ring is attached in the 2 or 1 position is correspondingly low. Particularly preferred materials are set forth in U.S. Pat. No. 3,320,174.

Other suitable anionic surfactants are the olefin sulfonates, including long-chain alkene sulfonates, long-chain hydroxyalkane sulfonates or mixtures of alkene sulfonates and hydroxyalkane sulfonates. These olefin sulfonate surfactants may be prepared in a known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of sultones and alkene sulfonic acids which is then treated to convert the sultones to sulfonates. Preferred olefin sulfonates contain from 14 to 16 carbon atoms in the R alkyl group and are obtained by sulfonating an 2 olefin.

Other examples of suitable anionic sulfonate surfactants are the paraffin sulfonates containing about 10 to 20, preferably about 13 to 17, carbon atoms. Primary paraffin sulfonates are made by reacting long-chain alpha olefins and bisulfites and paraffin sulfonates having the sulfonate group distributed along the paraffin chain are shown in U.S. Pat. Nos. 2,503,280; 2,507,088; 3,260,744; 3,372,188; and German Patent 735,096.

Examples of satisfactory anionic sulfate surfactants are the ethoxylated $C_8$–$C_{18}$ alkyl ether sulfate salts having the formula $R(OC_2H_4)n\ OSO_3M$ wherein n is 1 to 12, preferably 1 to 5, and M is a solubilizing cation selected from the group consisting of sodium, potassium, ammonium, magnesium and mono-, di- and triethanol ammonium ions. The ethoxylated alkyl ether sulfates are obtained by sulfating the condensation product of ethylene oxide with a $C_8$–$C_{18}$ alkanol and neutralizing the resultant product. The ethoxylated alkyl ether sulfates differ from one another in the number of moles of ethylene oxide reacted with one mole of alkanol. Preferred ethoxylated alkyl ether sulfates contain 10 to 16 carbon atoms in the alkyl group.

Generally, the proportion of the nonsoap-anionic surfactant which is a mixture of the sulfonate surfactant and the sulfate surfactant will be in the range of 5% to 26%, preferably from 10% to 24%, by weight of the dilute o/w microemulsion composition, wherein the ratio of paraffin sulfonate surfactant to the ethoxylated alkyl ether sulfate surfactant is about 1.2:1 to about 24:1, more preferably about 1.35:1 to about 15:1.

The biodegradable compounds used in the instant compositions (herein after referred to as ethoxylated glycerol type compound) is a mixture of a fully esterified ethoxylated polyhydric alcohol, a partially esterified ethoxylated polyhydric alcohol and a nonesterified ethoxylated polyhydric alcohol, wherein the preferred polyhydric alcohol is glycerol, and the compound is a mixture of:

Formula (I)

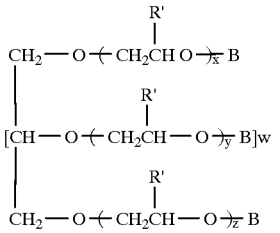

and

Formula (II)

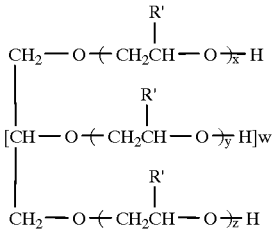

wherein w equals one to four, most preferably one. B is selected from the group consisting of hydrogen or a group represented by:

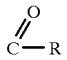

wherein R is selected from the group consisting of alkyl group having about 6 to 22 carbon atoms, more preferably about 11 to about 15 carbon atoms and alkenyl groups having about 6 to 22 carbon atoms, more preferably about 11 to 15 carbon atoms, wherein a hydrogenated tallow alkyl chain or a coco alkyl chain is most preferred, wherein at least one of the B groups is represented by said

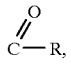

and R' is selected from the group consisting of hydrogen and methyl groups; x, y and z have a value between 0 and 60, more preferably 0 to 40, provided that (x+y+z) equals about 2 to about 100, preferably 4 to about 24 and most preferably about 4 to 19, wherein in Formula (I) the ratio of monoester/diester/triester is 45 to 90/5 to 40/1 to 20, more preferably 50 to 90/9 to 32/1 to 12, wherein the ratio of Formula (I) to Formula (II) is a value between about 3 to about 0.02, preferably 3 to about 0.1, most preferably about 1.5 to about 0.2, wherein it is most preferred that there is more of Formula (II) than Formula (I) in the mixture that forms the compound.

The ethoxylated glycerol type compound used in the instant composition is manufactured by the Kao Corporation and sold under the trade name Levenol such as Levenol F-200 which has an average EO of 6 and a molar ratio of coco fatty acid to glycerol of 0.55 or Levenol V501/2 which has an average EO of 17 and a molar ratio of tallow fatty acid to glycerol of 1.0. It is preferred that the molar ratio of the fatty acid to glycerol is less than about 1.7, more preferably less than about 1.5 and most preferably less than about 1.0. The ethoxylated glycerol type compound has a molecular weight of about 400 to about 1600, and a pH (50 grams/liter of water) of about 5–7. The Levenol compounds are substantially non irritant to human skin and have a primary biodegradabillity higher than 90% as measured by the Wickbold method Bias-7d.

Two examples of the Levenol compounds are Levenol V-501/2 which has 17 ethoxylated groups and is derived from tallow fatty acid with a fatty acid to glycerol ratio of 1.0 and a molecular weight of about 1465 and Levenol F-200 has 6 ethoxylated groups and is derived from coco fatty acid with a fatty acid to glycerol ratio of 0.55. Both Levenol F-200 and Levenol V-501/2 are composed of a mixture of Formula (I) and Formula (II). The Levenol compounds has ecoxicity values of algae growth inhibition>100 mg/liter; acute toxicity for Daphniae>100 mg/liter and acute fish toxicity>100 mg/liter. The Levenol compounds have a biodegradability higher than 60% which is the minimum required value according to OECD 301 B measurement to be acceptably biodegradable.

The water soluble zwitterionic surfactant, can be present in the liquid detergent composition, in an amount of 0 to 25 wt. %, more preferably 1 wt. % to 20 wt. %, most preferably 3 wt. % to 20 wt. %, and provides good foaming properties and mildness to the liquid detergent composition. The zwitterionic surfactant is a water soluble betaine or sultaine having the general formula:

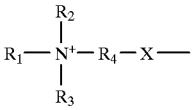

wherein X is selected from the group consisting of $CO_2^-$ and $SO_3^-$ wherein $R_1$ is an alkyl group having 10 to about 20 carbon atoms, preferably 12 to 16 carbon atoms, or the amido radical:

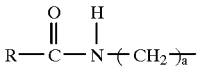

wherein R is an alkyl group having about 9 to 19 carbon atoms and a is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N,N-dimethyl-ammonia) acetate, coco dimethyl betaine or 2-(N-coco N,N-dimethylammonia) acetate, myristyl dimethyl betaine, palmityl dimethyl betaine, lauryl dimethyl betaine, cetyl dimethyl betaine, stearyl dimethyl betaine, etc. A preferred alkyl betaine is genagen LAB ex Hoechst. The amidobetaines similarly include cocoamidoethylbetaine, cocoamidopropyl betaine and the like. A preferred betaine is coco ($C_8$–$C_{18}$) amidopropyl dimethyl betaine. Two preferred betaine surfactants are Rewoteric AMB 13 and Golmschmidt Betaine L7.

The cosurfactant may play an essential role in the formation of the microemulsion compositions. Very briefly, in the absence of the cosurfactant the water, detergent(s) and hydrocarbon (e.g., perfume) will, when mixed in appropriate proportions form either a micellar solution (low concentration) or form an oil-in-water emulsion in the first aspect of the invention. With the cosurfactant added to this system, the interfacial tension at the interface between the emulsion droplets and aqueous phase is reduced to a very low value (never negative). This reduction of the interfacial tension results in spontaneous break-up of the emulsion droplets to consecutively smaller aggregates until the state of a transparent colloidal sized emulsion e.g., a microemulsion, is formed. In the state of a microemulsion, thermodynamic factors come into balance with varying degrees of stability related to the total free energy of the microemulsion. Some of the thermodynamic factors involved in determining the total free energy of the system are (1) particle-particle potential; (2) interfacial tension or free energy (stretching and bending); (3) droplet dispersion entropy; and (4) chemical potential changes upon formation. A thermodynamically stable system is achieved when (2) interfacial tension or free energy is minimized and (3) droplet dispersion entropy is maximized. Thus, the role of cosurfactant in formation of a stable o/w microemulsion is to (a) decrease interfacial tension (2); and (b) modify the microemulsion structure and increase the number of possible configurations (3). Also, the cosurfactant will (c) decrease the rigidity.

The major class of compounds found to provide highly suitable cosurfactants for the microemulsion over temperature ranges extending from 5° C. to 43° C. for instance are glycerol, ethylene glycol, water-soluble polyethylene glycols having a molecular weight of 300 to 1000, polypropylene glycol of the formula $HO(CH_3CHCH_2O)_nH$ wherein n is a number from 2 to 18, mixtures of polyethylene glycol and polypropyl glycol (Synalox) and mono $C_1$–$C_6$ alkyl ethers and esters of ethylene glycol and propylene glycol having the structural formulas $R(X)_nOH$ and $R_1(X)_nOH$ wherein R is $C_1$–$C_6$ alkyl group, $R_1$ is $C_2$–$C_4$ acyl group, X is $(OCH_2CH_2)$ or $(OCH_2(CH_3)CH)$ and n is a number from 1 to 4, diethylene glycol, triethylene glycol, an alkyl lactate, wherein the alkyl group has 1 to 6 carbon atoms, 1 methoxy-2-propanol, 1 methoxy-3-propanol, and 1 methoxy 2-, 3- or 4-butanol.

Representative members of the polypropylene glycol include dipropylene glycol and polypropylene glycol having a molecular weight of 200 to 1000, e.g., polypropylene glycol 400. Other satisfactory glycol ethers are ethylene glycol monobutyl ether (butyl cellosolve), diethylene glycol monobutyl ether (butyl carbitol), triethylene glycol monobutyl ether, mono, di, tri propylene glycol monobutyl ether, tetraethylene glycol monobutyl ether, mono, di, tripropylene glycol monomethyl ether, propylene glycol monomethyl ether, ethylene glycol monohexyl ether, diethylene glycol monohexyl ether, propylene glycol tertiary butyl ether, ethylene glycol monoethyl ether, ethylene glycol monomethyl ether, ethylene glycol monopropyl ether, ethylene glycol monopentyl ether, diethylene glycol monomethyl ether, diethylene glycol monoethyl ether, diethylene glycol monopropyl ether, diethylene glycol monopentyl ether, triethylene glycol monomethyl ether, triethylene glycol monoethyl ether, triethylene glycol monopropyl ether, triethylene glycol monopentyl ether, triethylene glycol monohexyl ether, mono, di, tripropylene glycol monoethyl ether, mono, di tripropylene glycol monopropyl ether, mono, di, tripropylene glycol monopentyl ether, mono, di, tripropylene glycol monohexyl ether, mono, di, tributylene glycol mono methyl ether, mono, di, tributylene glycol monoethyl ether, mono, di, tributylene glycol monopropyl ether, mono, di, tributylene glycol monobutyl ether, mono, di, tributylene glycol monopentyl ether and mono, di, tributylene glycol monohexyl ether, ethylene glycol monoacetate and dipropylene glycol propionate. When these glycol type cosurfactants are at a concentartion of about 1.0 to about 14 weight %, more preferably about 2.0 weight % to about 10 weight % in combination with a water insoluble hydrocarbon at a concentration of at least 0.5 weight %, more preferably 1.5 weight % one can form a microemulsion composition.

The amount of cosurfactant required to stabilize the microemulsion compositions will, of course, depend on such factors as the surface tension characteristics of the cosurfactant, the type and amounts of the primary surfactants and perfumes, and the type and amounts of any other additional ingredients which may be present in the composition and which have an influence on the thermodynamic factors enumerated above. Generally, amounts of cosurfactant in the range of from 0% to 25%, preferably from about 1% to 20%, especially preferably from about 2% to 15%, by weight provide stable dilute o/w microemulsions for the above-described levels of primary surfactants and perfume and any other additional ingredients as described below. The final essential ingredient in the inventive light duty liquid microemulsion compositions having improved interfacial tension properties is water. In addition to the above-described essential ingredients required for the formation of the microemulsion composition, the compositions of this invention may possibly contain one or more additional ingredients which serve to improve overall product performance.

One such ingredient is an inorganic or organic salt of oxide of a multivalent metal cation, particularly Mg++. The metal salt or oxide provides several benefits including improved cleaning performance in dilute usage, particularly in soft water areas, and minimized amounts of perfume required to obtain the microemulsion state. Magnesium sulfate, either anhydrous or hydrated (e.g., heptahydrate), is especially preferred as the magnesium salt. Good results also have been obtained with magnesium oxide, magnesium chloride, magnesium acetate, magnesium propionate and magnesium hydroxide. These magnesium salts can be used with formulations at neutral or acidic pH since magnesium hydroxide will not precipitate at these pH levels.

Although magnesium is the preferred multivalent metal from which the salts (inclusive of the oxide and hydroxide) are formed, other polyvalent metal ions also can be used provided that their salts are nontoxic and are soluble in the aqueous phase of the system at the desired pH level. Thus, depending on such factors as the nature of the primary surfactants and cosurfactant, and so on, as well as the availability and cost factors, other suitable polyvalent metal ions include aluminum, copper, nickel, iron, calcium, etc. It should be noted, for example, that with the preferred paraffin sulfonate anionic detergent calcium salts will precipitate and should not be used. It has also been found that the aluminum salts work best at pH below 5 or when a low level, for example about 1 weight percent, of citric acid is added to the composition which is designed to have a neutral pH. Alternatively, the aluminum salt can be directly added as the citrate in such case. As the salt, the same general classes of anions as mentioned for the magnesium salts can be used, such as halide (e.g., bromide, chloride), sulfate, nitrate, hydroxide, oxide, acetate, propionate, etc.

Preferably, in the dilute compositions the metal compound is added to the composition in an amount sufficient to provide at least a stoichiometric equivalent between the anionic surfactant and the multivalent metal cation. For example, for each gram-ion of Mg++ there will be 2 gram moles of paraffin sulfonate, alkylbenzene sulfonate, etc., while for each gram-ion of $A1^3$+ there will be 3 gram moles of anionic surfactant. Thus, the proportion of the multivalent salt generally will be selected so that one equivalent of compound will neutralize from 0.1 to 1.5 equivalents, preferably 0.9 to 1.4 equivalents, of the acid form of the anionic detergent. At higher concentrations of anionic detergent, the amount of multivalent salt will be in range of 0.5 to 1 equivalents per equivalent of anionic detergent.

The light duty liquid microemulsion composition of this invention may, if desired, also contain other components either to provide additional effect or to make the product more attractive to the consumer. The following are mentioned by way of example: Colors or dyes in amounts up to 0.5% by weight; bactericides in amounts up to 1% by weight; preservatives or antioxidizing agents, such as formalin, 5-chloro-2-methyl-4-isothaliazolin-3-one, 2,6-di-tert.butyl-p-cresol, etc., in amounts up to 2% by weight; and pH adjusting agents, such as sulfuric acid or sodium hydroxide, as needed.

The instant compositions can contain 0 to about 2.5 wt. %, more preferably about 0.025 to about 2.0 wt. %, most preferably about 0.05 to about 1.0 wt. % of an antibacterial agent. A preferred antibacterial agent is trichlorohydroxydiphenyl ether.

Because the compositions as prepared are aqueous liquid formulations and since no particular mixing is required to form the o/w microemulsion, the compositions are easily prepared simply by combining all the ingredients in a suitable vessel or container. The order of mixing the ingredients is not particularly important and generally the various ingredients can be added sequentially or all at once or in the form of aqueous solutions of each or all of the primary detergents and cosurfactants can be separately prepared and combined with each other and with the perfume. The magnesium salt, or other multivalent metal compound, when present, can be added as an aqueous solution thereof or can be added directly. It is not necessary to use elevated temperatures in the formation step and room temperature is sufficient.

The instant microemulsion formulas explicitly excludes fatty acids, alkali metal silicates and alkali metal builders such as alkali metal polyphosphates, alkali metal carbonates, alkali metal phosphonates and alkali metal citrates because these materials, if used in the instant composition, would cause the composition to have a high pH as well as leaving residue on the surface being cleaned.

The instant liquid compositions have a light transmission of at least 95% and a minimum foam profile of at least about 25 ml, more preferably at least about 50 ml as measured by the foam profile test set forth in footnote 1 to the Table in Example I herein.

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

EXAMPLE 1

The following compositions in wt. % were prepared

| | A | B | C | D | E | F | G | H |
|---|---|---|---|---|---|---|---|---|
| Sodium $C_{13}$–$C_{17}$ Paraffin Sulfonate | 8.7 | 7.4 | 7.5 | 6.1 | — | — | — | — |
| Sodium ethoxylated $C_{12-14}$ alkyl ether sulfate (2EO) | 2.9 | 2.5 | 2.5 | 2.0 | 1.30 | 12.5 | 2.5 | 12.5 |
| $C_{12}$–$C_{14}$ dimethyl betaine | | | | | 12.2 | 1.0 | 11 | 1.0 |
| D-Limonene | 6 | 6 | 6 | | 6 | 6 | 6 | 6 |
| Alpha-Terpinol | | | | 6 | | | | |
| Glycerol | | 5 | | | | | | |
| Propylene glycol | 5 | | | | 5 | 5 | | |
| Dipropylene glycol monomethyl ether | | | 5 | 10 | | | 5 | 5 |
| Levenol F200 | 18.7 | 20.4 | 20.4 | 20.4 | 11.9 | 11.9 | 11.9 | 11.9 |
| Light transmission % | >98 | >98 | >98 | >98 | >98 | >98 | >98 | >98 |
| Brookfield viscosity, 25° C. #2 spindle, 30 rpms (cps) | 300 | 250 | 150 | 150 | 150 | 150 | 200 | 300 |
| Miniplate test | 10 | 13 | 10 | 11 | 30 | 13 | 30 | — |
| Foam Vol (ml) Foam profile(1) | 50 | 25 | 50 | 25 | 265 | 300 | 195 | 250 |
| Static degreasing (vs mrkt product) | + | ++ | ++ | ++ | + | ++ | +++ | +++ |

| | I | J | K | L | M | N | O | P |
|---|---|---|---|---|---|---|---|---|
| Sodium $C_{13}$–$C_{17}$ Paraffin Sulfonate | | 4.75 | 17.6 | — | — | 16.3 | — | — |
| Sodium ethoxylated $C_{12-14}$ alkyl ether sulfate (2EO) | 2.5 | 7.5 | 5.85 | 18.7 | 11.3 | 5.4 | 17.5 | 11.2 |
| $C_{12}$–$C_{14}$ dimethyl betaine | 17.2 | | | 1.5 | 1.0 | | 2.25 | 1.0 |
| D-Limonene | 6 | 6 | 6 | 6 | 6 | 6 | 6 | 6 |
| Alpha-Terpinol | | | | | | | | |
| Glycerol | | | | | | | | |
| Propylene glycol | 5 | 5 | 5 | | 5 | | | |
| Dipropylene glycol monomethyl ether | | | | 5 | | 10 | 5 | 5 |
| Levenol F200 | 3.4 | 13.6 | 6.8 | 3.4 | 13.6 | | 3.4 | 13.6 |
| Light transmission % | >98 | >98 | >98 | >98 | >98 | >98 | >98 | >98 |
| Brookfield viscosity, 25° C. #2 spindle, 30 rpms (Cps) | 150 | 150 | 125 | 150 | 125 | 125 | 100 | 130 |

(1) A solution of 75 grams of the composition to be tested, 1 gram of corn oil and 1000 ml of water is prepared. The solution at 47° C. is placed in a 500 ml graduated cylinder and rotated for 55 revolutions at 35 rpms and then left at rest for 2 minutes. The height of the generated foam in the 500 ml graduated cylinder is measured and recorded in ml.

In summary, the described invention broadly relates to an improvement in a light duty liquid microemulsion compositions containing a mixture of a paraffin sulfonate surfactant and an ethoxylated alkyl ether sulfate, optionally a zwitterionic surfactant, a biodegradable compound, one of the specified cosurfactants, a hydrocarbon ingredient and water.

What is claimed:

1. A light duty liquid microemulsion composition comprising approximately by weight:

(a) 2% to 20% of a mixture of a fully esterified ethoxylated polyhydric alcohol, an ethoxylated nonesterified polyhydric alcohol and an ethoxylated partially esterified ethoxylated polyhydric alcohol as depicted by the formulas:

(I)

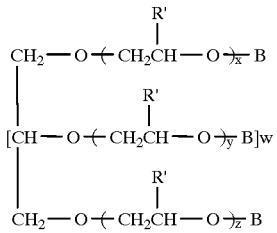

and (II)

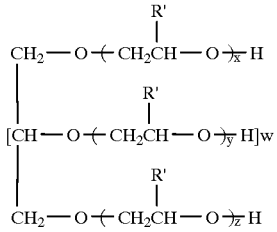

wherein w equals one to four, B is selected from the group consisting of hydrogen or a group represented by:

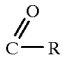

wherein R is selected from the group consisting of alkyl group having about 6 to 22 carbon atoms, and alkenyl groups having about 6 to 22 carbon atoms, wherein at least one of the B groups is represented by said

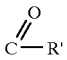

and R' is selected from the group consisting of hydrogen and methyl groups; x, y and z have a value between 0 and 60, provided that (x+y+z) equals about 2 to about 100, wherein the ratio of monoester/diester/triester is 45 to 90/5 to 40/1 to 20, wherein the ratio of Formula (I) to Formula (II) is a value between about 1.5 to about 2;

(b) 0–25% of a zwitterionic surfactant;

(c) 5% to 26% of a sulfate surfactant selected from the group consisting of C8–18 alkyl sulfates and ethoxylated C8–C18 alkyl ether sulfates;

(d) 0.4% to 10% of a perfume, essential oil or a water insoluble paraffin or isoparaffin having about 6 to 18 carbon atoms;

(e) 0 to 25% of a cosurfactant selected from the group consisting of C1–C6 alkyl ethers and esters of ethylene glycol and propylene glycol having the formula $R(X)_nOH$ and $R_1(X)_nOH$ wherein R is a C1–C6 alkyl group, $R_1$ is a C2–C4 acyl group and X is $(OCH_2CH_2)$ or $(OCH_2(CH_3)CH)$ and n is a number from 1 to 4; and (f) the balance being water, said composition having a pH of 5–7.

2. The composition of claim 1 which further contains a salt of a multivalent metal cation in an amount sufficient to provide from 0.5 to 1.5 equivalents of said cation per equivalent of said sulfonate and sulfate surfactants.

3. The composition of claim 2 wherein the multivalent metal cation is magnesium or aluminum.

4. The composition of claim 1 further including 0.05 wt. % to 1.0 wt. % of an antibacterial agent.

5. The composition of claim 3 wherein said multivalent salt is magnesium sulfate.

6. The composition of claim 1 wherein the cosurfactant is selected from the group consisting of ethylene glycol monobutylether, diethylene glycol monobutyl ether, triethylene glycol monobutylether, dipropylene glycol monomethyl ether, propylene glycol monomethyl ether, polypropylene glycol having an average molecular weight of from about 200 to 1,000, propylene glycol tert-butyl ether, mono, di, tri-propylene glycol monobutyl ether and polyethylene glycol and mixtures thereof.

7. The composition of claim 6 wherein the cosurfactant is dipropylene glycol monomethyl ether or diethylene glycol monomethyl ether.

8. The composition of claim 1, wherein the concentration of the zwitterionic surfactant is about 1 wt. % to about 20.0 wt. %.

* * * * *